US011819131B2

(12) United States Patent
Iles et al.

(10) Patent No.: US 11,819,131 B2
(45) **Date of Patent: *Nov. 21, 2023**

(54) BUOYANT POOL LOUNGE CHAIR FRAME AND BUOYANT POOL LOUNGE CHAIR USING THE SAME

(71) Applicant: TRC Recreation, LP, Wichita Falls, TX (US)

(72) Inventors: Matthew J. Iles, Graham, TX (US); Christopher B. Holland, Graham, TX (US); Michael V. Nelson, Wichita Falls, TX (US)

(73) Assignee: TRC Recreation, LP, Wichita Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/820,024

(22) Filed: Aug. 16, 2022

(65) Prior Publication Data

US 2022/0386782 A1 Dec. 8, 2022

Related U.S. Application Data

(63) Continuation of application No. 17/022,620, filed on Sep. 16, 2020, now Pat. No. 11,412,858, which is a continuation of application No. 16/566,454, filed on Sep. 10, 2019, now Pat. No. 10,786,084, which is a continuation of application No. 16/138,352, filed on Sep. 21, 2018, now Pat. No. 10,426,272.

(60) Provisional application No. 62/568,599, filed on Oct. 5, 2017.

(51) Int. Cl.

| | |
|---|---|
| ***A47C 15/00*** | (2006.01) |
| ***A47C 1/027*** | (2006.01) |
| ***A47C 7/62*** | (2006.01) |
| ***A47C 7/50*** | (2006.01) |

(52) U.S. Cl.

CPC ..... *A47C 15/006* (2013.01); *A47C 1/027* (2013.01); *A47C 7/5066* (2018.08); *A47C 7/624* (2018.08)

(58) Field of Classification Search

CPC ..... A47C 15/006; A47C 7/624; A47C 7/5066; A47C 1/027; B63B 35/74

See application file for complete search history.

(56) References Cited

U.S. PATENT DOCUMENTS

| | | | |
|---|---|---|---|
| 3,074,759 | A | 1/1963 | Bergenwall |
| 3,154,345 | A | 10/1964 | Lambrecht |
| 3,620,570 | A | 11/1971 | Wilson |

(Continued)

*Primary Examiner* — Stephen P Avila

(74) *Attorney, Agent, or Firm* — Scott Griggs; Griggs Bergen LLP

(57) ABSTRACT

A buoyant pool lounge chair frame and buoyant pool lounge chair using the same are disclosed. In one embodiment of the buoyant pool lounge chair for supporting a person while the buoyant pool chair is floating in water, frame members collectively form an open chair frame including a back frame and leg frame pivotally coupled thereto. Buoyant cushions are attached to the frame members to form a chair seat, a backrest, and a leg rest. A pair of rear pivotal coupling and clutch assemblies are coupled to the seat frame and to the back frame to adjust and fix the angle of recline of the back frame relative to the seat frame. Similarly, a pair of front pivotal coupling and clutch assemblies coupled to the leg frame and to the back frame to adjust and fix the angle of extension of the leg frame relative to the seat frame.

20 Claims, 5 Drawing Sheets

(56) References Cited

U.S. PATENT DOCUMENTS

| | | | | |
|---|---|---|---|---|
| 3,984,888 | A | 10/1976 | DeLano | |
| 4,026,567 | A | 5/1977 | Rye | |
| 4,141,585 | A | 2/1979 | Blackman | |
| 4,358,866 | A | 11/1982 | Rhodes | |
| 4,384,857 | A | 5/1983 | Hoy, Jr. | |
| 4,435,165 | A | 3/1984 | Johnson | |
| 4,484,781 | A | 11/1984 | Phelps | |
| 4,662,852 | A | 5/1987 | Schneider et al. | |
| 4,884,840 | A | 12/1989 | Linden et al. | |
| 5,004,296 | A | 4/1991 | Ziegenfuss, Jr. | |
| 5,052,965 | A | 10/1991 | Klapp et al. | |
| 5,088,723 | A | 2/1992 | Simmons | |
| 5,226,184 | A | 7/1993 | Cheng | |
| 5,307,527 | A | 5/1994 | Schober | |
| 5,403,220 | A | 4/1995 | Goad, Sr. | |
| 5,439,405 | A | 8/1995 | Storey et al. | |
| 6,045,423 | A | 4/2000 | Silva | |
| 6,059,360 | A | 5/2000 | Bedard | |
| 6,086,150 | A | 7/2000 | Scheurer et al. | |
| 6,312,054 | B1 | 11/2001 | Scheurer et al. | |
| 6,527,343 | B2 | 3/2003 | Scheurer et al. | |
| 6,783,181 | B2 | 8/2004 | Scheurer et al. | |
| 7,182,401 | B2 | 2/2007 | Scheurer et al. | |
| 7,549,706 | B2 | 6/2009 | Scheurer | |
| 10,426,272 | B2 * | 10/2019 | Iles | A47C 15/006 |
| 10,786,084 | B2 * | 9/2020 | Iles | A47C 7/624 |
| 11,412,858 | B2 * | 8/2022 | Iles | A47C 7/5066 |
| 2004/0232753 | A1 | 11/2004 | Scheurer et al. | |
| 2006/0061180 | A1 | 3/2006 | Scheurer et al. | |
| 2008/0203802 | A1 | 8/2008 | LaFreniere | |
| 2019/0104855 | A1 | 4/2019 | Iles et al. | |
| 2020/0000239 | A1 | 1/2020 | Iles et al. | |

* cited by examiner

BUOYANT POOL LOUNGE CHAIR FRAME AND BUOYANT POOL LOUNGE CHAIR USING THE SAME

PRIORITY STATEMENT & CROSS-REFERENCE TO RELATED APPLICATIONS

This application is a continuation of U.S. patent application Ser. No. 17/022,620 entitled "Buoyant Pool Lounge Chair Frame and Buoyant Pool Lounge Chair Using the Same" filed Sep. 16, 2020, in the names of Matthew J. Iles et al., now U.S. Pat. No. 11,412,858, issued on Aug. 16, 2022; which is a continuation of U.S. patent application Ser. No. 16/566,454 entitled "Buoyant Pool Lounge Chair Frame and Buoyant Pool Lounge Chair Using the Same" filed Sep. 10, 2019, in the names of Matthew J. Iles et al, now U.S. Pat. No. 10,786,084, issued on Sep. 29, 2020; which is a continuation of U.S. patent application Ser. No. 16/138,352 entitled "Buoyant Pool Lounge Chair Frame and Buoyant Pool Lounge Chair Using the Same" filed Sep. 21, 2018, in the names of Matthew J. Iles et al., now U.S. Pat. No. 10,426,272, issued on Oct. 1, 2019; which claims priority from U.S. Patent Application Ser. No. 62/568,599 entitled "Buoyant Pool Lounge Chair Frame and Buoyant Pool Lounge Chair Using the Same" filed on Oct. 5, 2017, in the names of Matthew J. Iles et al.; all of which are hereby incorporated by reference, in entirety, for all purposes.

TECHNICAL FIELD OF THE INVENTION

This invention relates, in general, to swimming pool accessories, and, in particular, to a buoyant pool lounge chair frame and a buoyant pool lounge chair utilizing the same for supporting a person in a seated position while the buoyant pool lounge chair frame is floating in water.

BACKGROUND OF THE INVENTION

Swimming pools offer personal recreation and relaxation in a variety of settings, including private homes, apartment complexes, motels, resorts, and country clubs. Various flotation devices including buoyant chairs, rafts, water wings, floating cushions, body floats and air mattresses are used by swimmers as an aid for floating and relaxing on the surface of the water, while remaining seated upright, reclining or lounging, either partially or completely submerged. These items of pool furniture include flotation cushions made of a buoyant material such as open cell foam, closed cell foam, cork, kapok, fiberglass or balsa wood, which are sealed within a protective outer covering. Special care should be taken in the construction of buoyant lounge chairs to provide comfort while maintaining a sufficient buoyancy material to furnish a comfortable and stable upright orientation while the occupant is in a semi-reclining or sitting orientation. The buoyant lounge chair may overturn in response to shifting of its center of buoyancy as the occupant turns or moves about and, as a result, there is a continuing need for improved design that also meets expectations of ever increasing comfort.

SUMMARY OF THE INVENTION

It would be advantageous to achieve a buoyant pool lounge chair frame and a buoyant pool lounge chair utilizing the same for providing support for a swimmer in an upright, semi-reclining or sitting position that would improve upon existing limitations in stability and functionality. It would also be desirable to enable a mechanical solution that satisfies comfort while mitigating or eliminating the chances of the buoyant pool lounge chair being overturned in response to shifting of its center or buoyancy. To better address one or more of these concerns, a buoyant pool lounge chair frame and a buoyant pool lounge chair utilizing the same are disclosed.

In one embodiment of the buoyant pool lounge chair for supporting a person while the buoyant pool chair is floating in water, frame members collectively forming an open chair frame including a seat frame having a back frame and leg frame pivotally coupled thereto. Buoyant cushions are attached to the frame members to form a chair seat, a backrest, and a leg rest. A pair of rear pivotal coupling and clutch assemblies are coupled to the seat frame and to the back frame to adjust and fix the angle of recline of the back frame relative to the seat frame. Similarly, a pair of front pivotal coupling and clutch assemblies coupled to the leg frame and to the back frame to adjust and fix the angle of extension of the leg frame relative to the seat frame. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
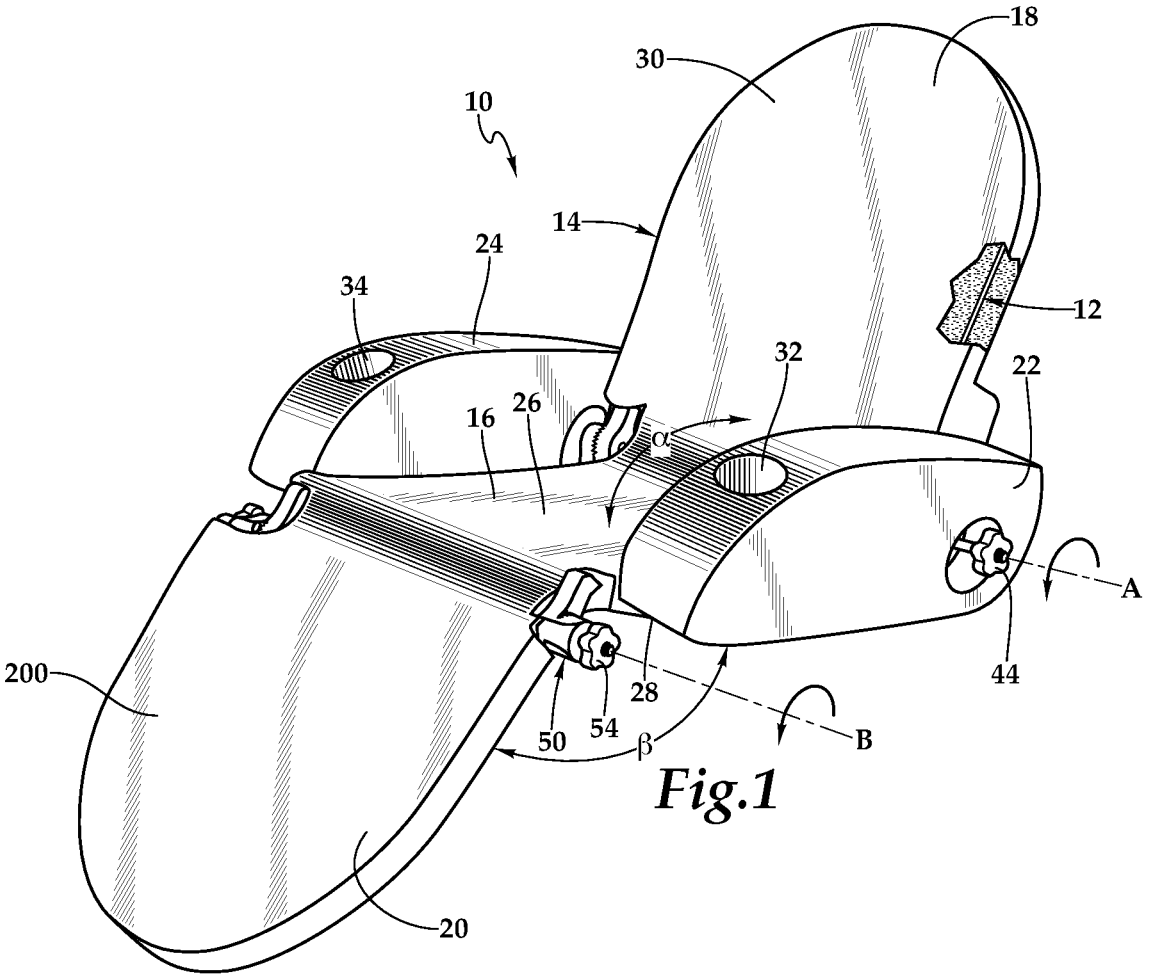
FIG. 1 is a front perspective view of one embodiment of a buoyant pool lounge chair having a buoyant pool lounge chair frame therein, according to the teachings presented herein.
Figure 2:
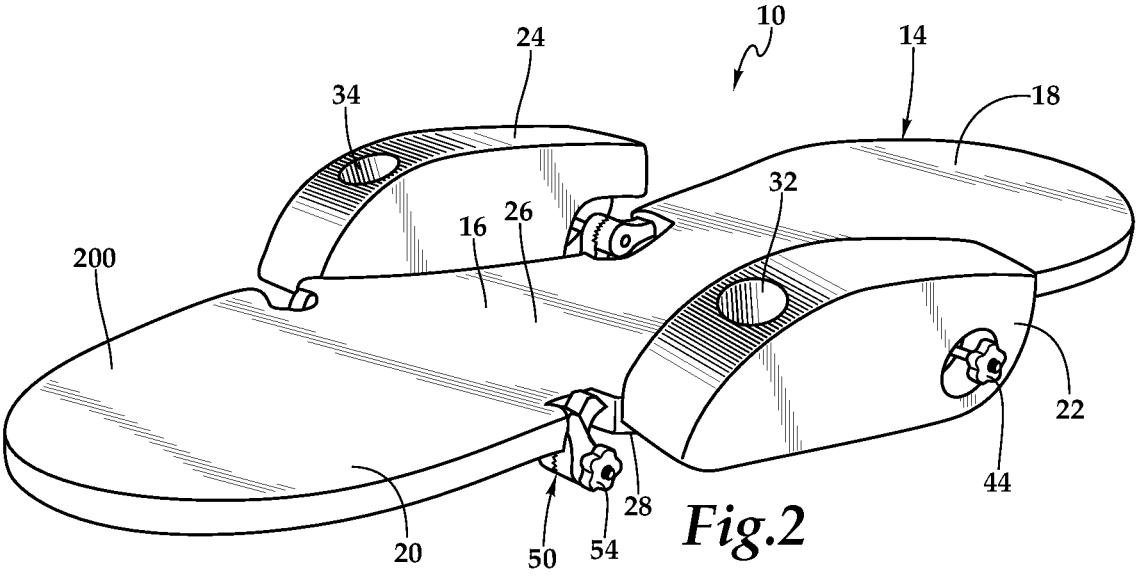
FIG. 2 is a front perspective view of the buoyant pool lounge chair depicted in FIG. 1 in an extended, fully reclined position.
Figure 3:
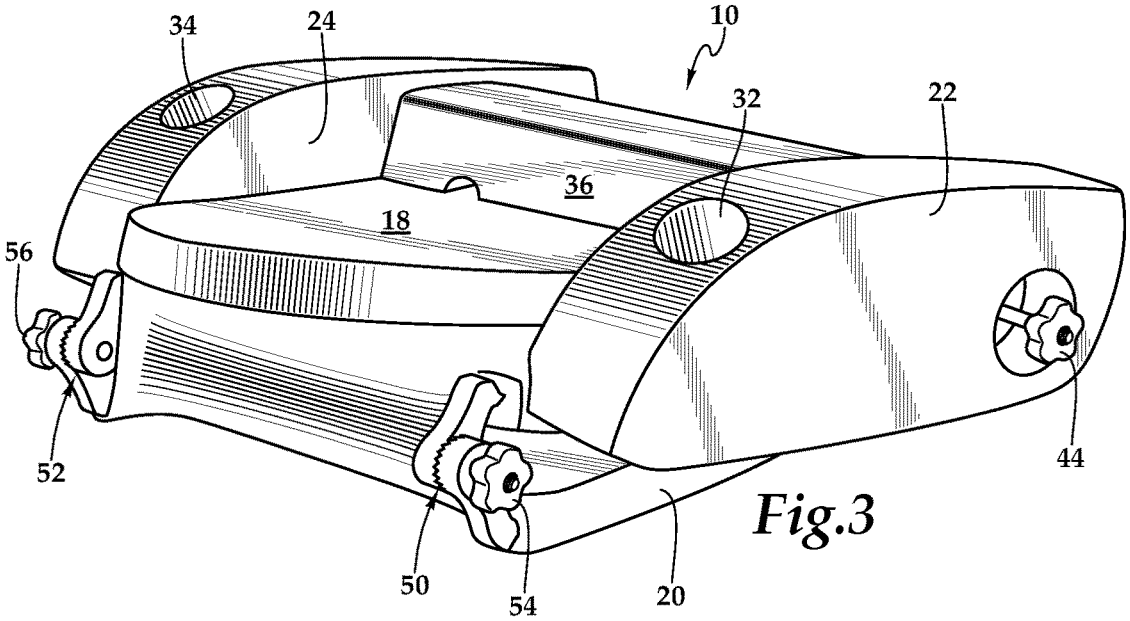
FIG. 3 is a front perspective view of the buoyant pool lounge chair depicted in FIG. 1 in a compact, fully folded position.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Referring now to FIG. 1 through FIG. 4, therein is depicted one embodiment of a buoyant pool lounge chair, which is schematically illustrated and designated 10. As will be discussed in detail hereinbelow, a buoyant pool lounge chair frame 12 is located within the buoyant pool lounge chair 10. As shown, buoyant cushions 14 may be attached to the buoyant pool lounge chair frame such that the buoyant cushions 14 form a chair seat 16, a backrest 18, a leg rest 20, a left arm rest 22, and a right arm rest 24. The chair seat 16 includes a top side 26 and a bottom side 28. A head support cushion 30 may be secured to the chair seat 16. Cup holders 32, 34 may be respectively located in the left arm rest 22 and the right arm rest 24. In one embodiment, a rear bolster cushion 36 extends from the rear of the backrest 18 to provide additional support and balance to the buoyant pool lounge chair 10.

In one embodiment, rear pivotal coupling and clutch assemblies 40, 42 are coupled to the buoyant pool lounge chair frame 12. As shown, the rear pivotal coupling and clutch assemblies 40, 42 respectively include adjustment knobs 44, 46. By rotation of the adjustment knobs 44, 46 along mutual axis A, each of the pair of the rear pivotal coupling and clutch assemblies 40, 42 permit pivotal movement of the backrest 18 relative to the chair seat 16, and engageable to fix the angle of recline, α, of the backrest 18 relative to the chair seat 16. Similarly, in one embodiment, front pivotal coupling and clutch assemblies 50, 52 are coupled to the buoyant pool lounge chair frame 12. As shown, the front pivotal coupling and clutch assemblies 50, 52 respectively include adjustment knobs 54, 56. By rotation of the adjustment knobs 54, 56 along mutual axis B, each of the pair of the front pivotal coupling and clutch assemblies 50, 52 permit pivotal movement of the leg rest 20 relative to the chair seat 16, and engageable to fix the angle of extension, β, of the leg rest 20 relative to the chair seat 16.

Figure 4:
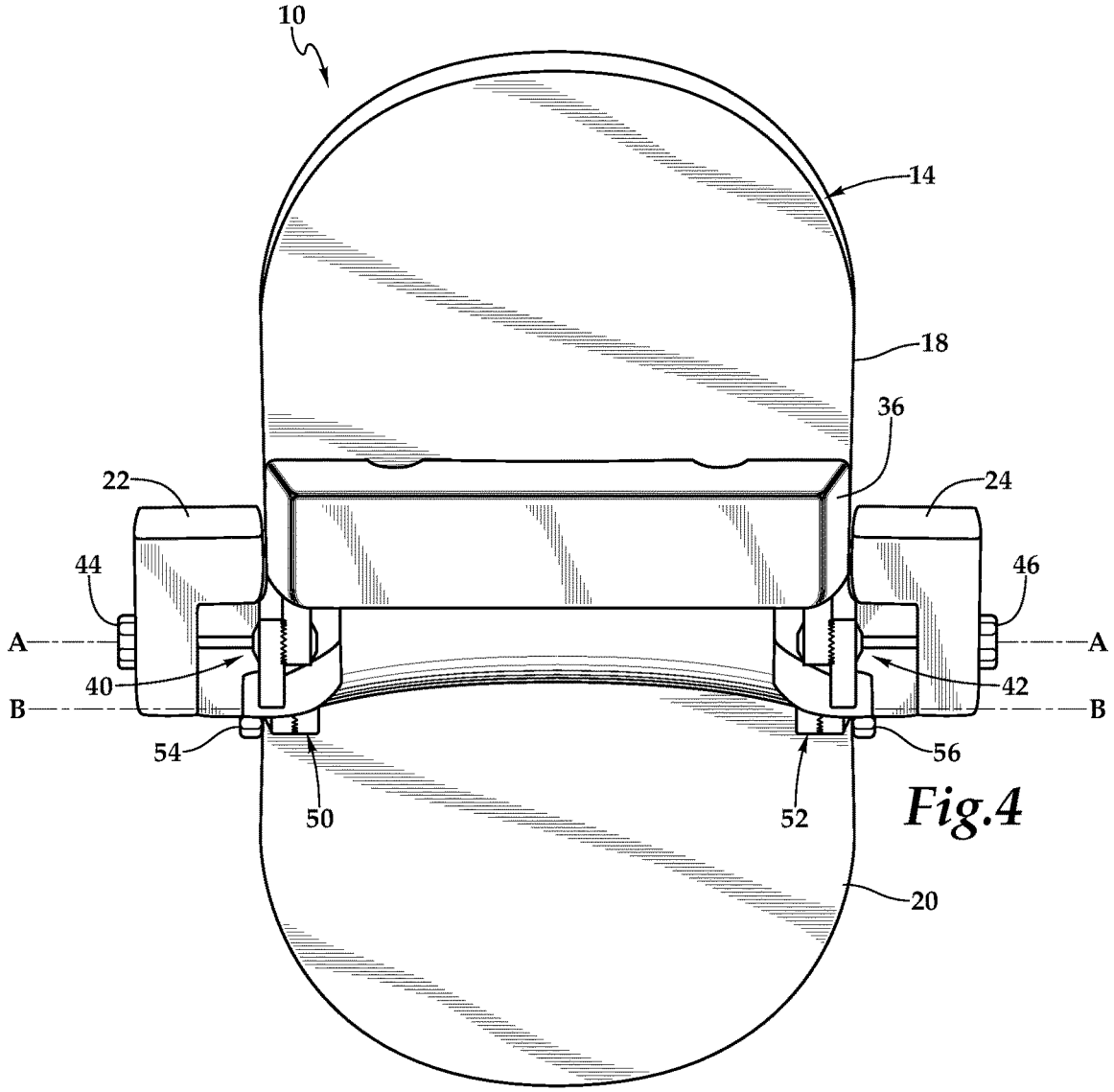
FIG. 4 is a rear elevation view of the buoyant pool lounge chair depicted in FIG. 1.

The pair of rear pivotal coupling and clutch assemblies 40, 42 permit pivotal movement of the backrest 18 relative to the chair seat 16 such that the backrest 18 is in proximate contact with the top side 26 of the chair seat 16. The pair of front pivotal coupling and clutch assemblies 50, 52 permit pivotal movement of the leg rest 20 relative to the chair seat 16 such that the leg rest 20 is in proximate contact with the bottom side 28 of the chair seat 16. As best illustrated in FIG. 4, the pair of rear pivotal coupling and clutch assemblies 40, 42 and the pair of front pivotal coupling and clutch assemblies 50, 52 cooperate in pivotal movement to provide a storage configuration wherein the backrest 18 is in proximate contact with the top side 26 of the chair seat 16 and the leg rest 20 is in proximate contact with the bottom side 28 of the chair seat 16.

In one embodiment, the buoyant pool lounge chair 10 may be relatively light weight for selectively supporting a person in seated, semi-reclining, and fully-reclining lounge positions while the buoyant pool lounge chair 10 is floating in water. As shown, the buoyant pool lounge chair 10 includes a chair seat 16, an adjustable backrest 18, an adjustable leg rest 20, left arm rest 22, and right arm rest 24, which provide full body support in the seated, upright, semi-reclining, and fully reclining lounge positions. The operative upright floating position refers to the flotation orientation of the buoyant pool lounge chair 10 with the adjustable backrest 18 and left and right arm rests 22, 24 generally upright while the chair seat 16 is generally horizontal and at least partially submerged as indicated in FIG. 1. When the buoyant pool lounge chair 10 is floating in water, the occupant is supported in a comfortable lounging orientation with arms being supported by the left and right arm rests 22, 24 and head being supported by the head cushion 30 on the adjustable backrest 18. The occupant's legs are supported by the adjustable leg rest 20, which projects at varying angles forwardly from the chair seat 16. The adjustable backrest 18 and adjustable leg rest 20 provide for dual hinge adjustable reclining.

Figure 5:
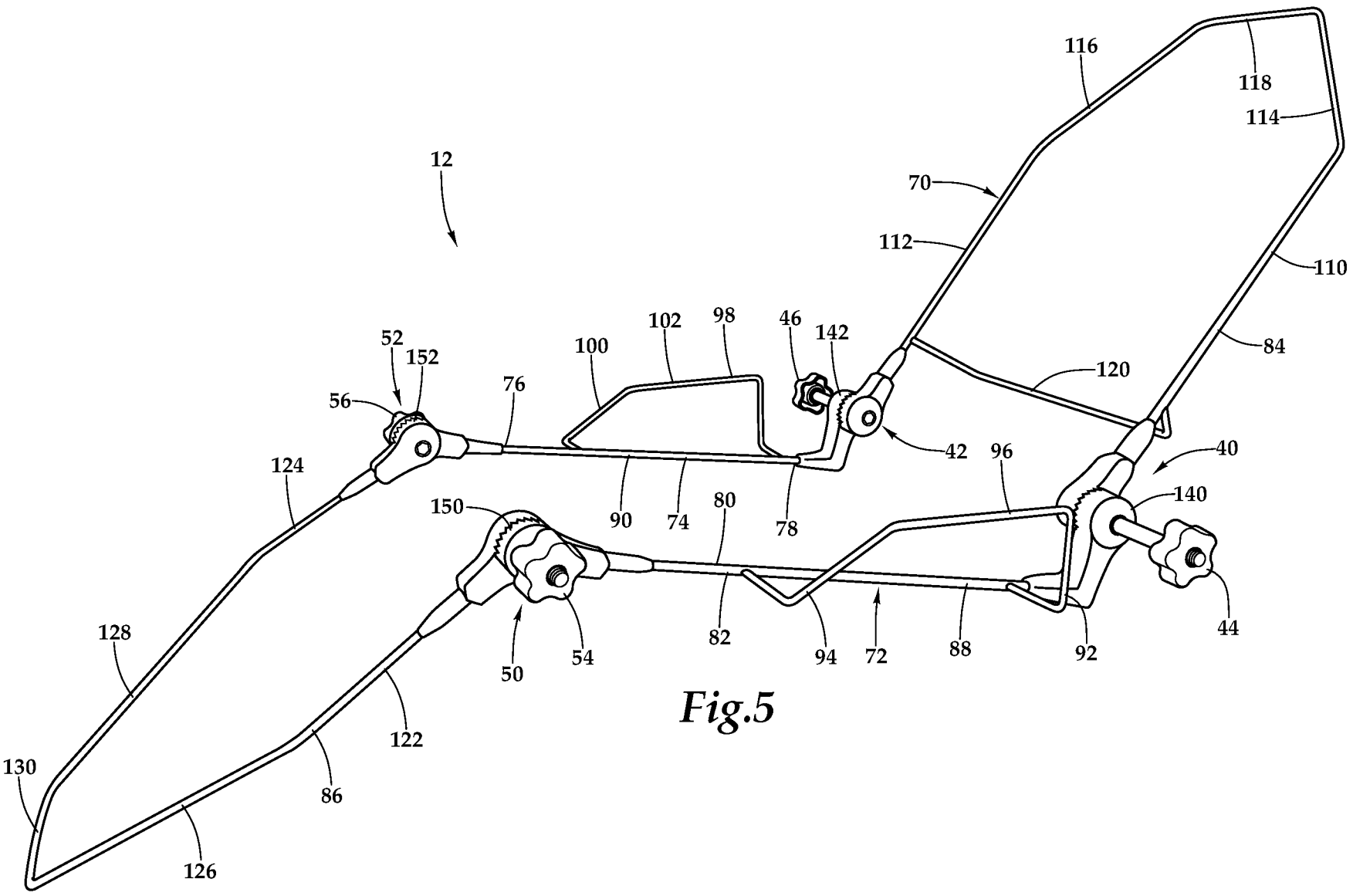
FIG. 5 is a side perspective view of one embodiment of a buoyant pool lounge chair frame according to the teachings presented herein.
Figure 6:
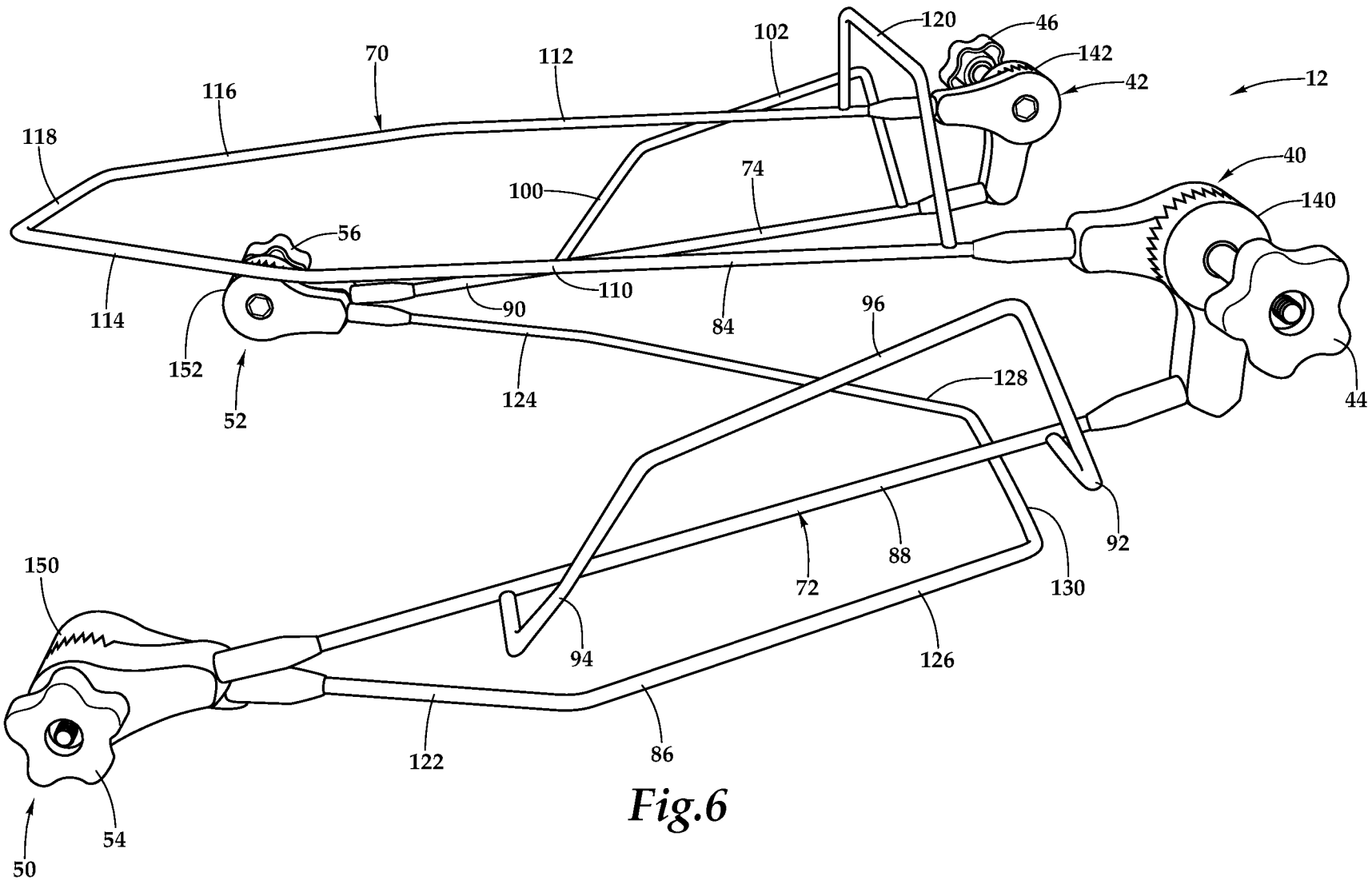
FIG. 6 is a side perspective view of the buoyant pool lounge chair frame depicted in FIG. 5 in a compact, fully folded position.

Referring now to FIG. 5 and FIG. 6, therein is depicted one embodiment of the buoyant pool lounge chair frame 12. Frame members 70 collectively form an open chair frame 72 including a seat frame 74 having a front end 76 and a rear end 78 and a top side 80 and a bottom side 82. A back frame 84 is pivotally coupled to the rear end 78 of the seat frame 74 and a leg frame 86 is pivotally coupled to the front end 76 of the seat frame 74. As shown, the seat frame includes parallel seat support members 88, 90. A left arm frame 92 includes an arm support riser 94 that is laterally offset from the parallel seat support member 88 of the seat frame 74 and an arm rest segment 96 that is vertically offset from the seat frame 74. A right arm frame 98 includes an arm support riser 100 that is laterally offset from the parallel seat support member 90 of the seat frame 74 and an arm rest segment 102 that is vertically offset from the seat frame 74. As previously discussed, the buoyant cushions 14 are attached to the left arm frame 92 and the right arm frame 98 forming the left and right arms rests 22, 24.

In one embodiment, the back frame 84 may include back support members 110, 112 having respective back segments 114, 116 projecting therefrom and intersecting respective ends of a central back segment 118. A back cross member 120 extends from the back support member 110 to the back support member 112. The rear bolster cushion 36 may extend from the back cross member 120. Similarly, in one embodiment, the leg frame 86 may include leg support members 122, 124 having respective leg segments 126, 128 projecting therefrom and intersecting respective ends of a central leg segment 130. In one embodiment, a grommet (not shown) may be attached to the central leg segment 130.

The pair of rear pivotal coupling and clutch assemblies 40, 42 are coupled to the seat frame 74 and to the back frame 84 to permit pivotal movement of the back frame 84 relative to the seat frame 74, and engageable to fix the angle of recline, α, of the back frame 84 relative to the seat frame 74. The pair of front pivotal coupling and clutch assemblies 50, 52 are coupled to the leg frame 86 and to the seat frame 74 to permit pivotal movement of the leg frame 86 relative to the seat frame 74, and engageable to fix the angle of extension, β, of the leg frame 86 relative to the seat frame 74. The pair of rear pivotal coupling and clutch assemblies 40, 42 permit pivotal movement of the back frame 84 relative to the seat frame 74 such that the back frame 84 is in proximate contact with the top side 80 of the seat frame 74. The pair of front pivotal coupling and clutch assemblies 50, 52 permit pivotal movement of the leg frame 86 relative to the seat frame 74 such that the leg frame 86 is in proximate contact with the bottom side 82 of the seat frame 74. As shown best in FIG. 8, the pair of front pivotal coupling and clutch assemblies 50, 52 and the pair of rear pivotal coupling and clutch assemblies 40, 42 cooperate in pivotal movement to provide a storage configuration wherein the back frame 84 is in proximate contact with the top side 80 of the seat frame 74 and the leg frame 86 is in proximate contact with the bottom side 82 of the seat frame 74.

Referring to FIG. 1 through FIG. 6, with respect to the pair of front pivotal coupling and clutch assemblies 50, 52 and the pair of rear pivotal coupling and clutch assemblies 40, 42 in one embodiment, a pair of back pivotal apparatus 140, 142 coupled to the seat frame 74 and to the back frame 84 may be utilized to permit closing rotational movement of the back frame 84 toward the top side 80 of the seat frame 74 to a folded position in which the back frame 84 extends proximate the top side 80 of the seat frame 74. Further, the pair of back pivotal apparatus 140, 142 may permit opening rotational movement of the back frame 84 away from the top side 80 of the seat frame 74 to an upright position in which the back frame 84 projects transversely to the seat frame 74. With respect to the leg rest 20 and leg frame 86, a pair of front pivotal apparatus 150, 152 coupled to the seat frame 74 and to the leg frame 86 may be utilized to permit closing rotational movement of the leg frame 86 toward the bottom side 82 of the seat frame 74 to a folded position in which the leg frame 86 extends proximate the bottom side 82 of the seat frame 74. Moreover, the pair of front pivotal apparatus 150, 152 may permit opening rotational movement of the leg frame 86 away from the bottom side 82 of the seat frame 74 to an extended position in which the leg frame 86 projects forward from the seat frame 74. In some embodiments, the pair of back pivotal apparatus 140, 142 and the pair of front pivotal apparatus 150, 152 cooperate in rotational movement to provide a storage configuration wherein the back frame 84 is in proximate contact with the top side 80 of the seat frame 74 and the leg frame 86 is in proximate contact with the bottom side 82 of the seat frame 74.

Figure 7A:
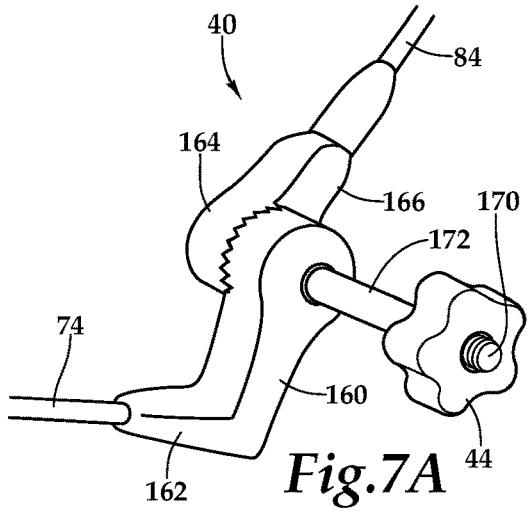
FIG. 7A is a front perspective view, partially broken away, of one embodiment of a rear pivotal coupling and clutch assembly shown in FIG. 5.
Figure 7B:
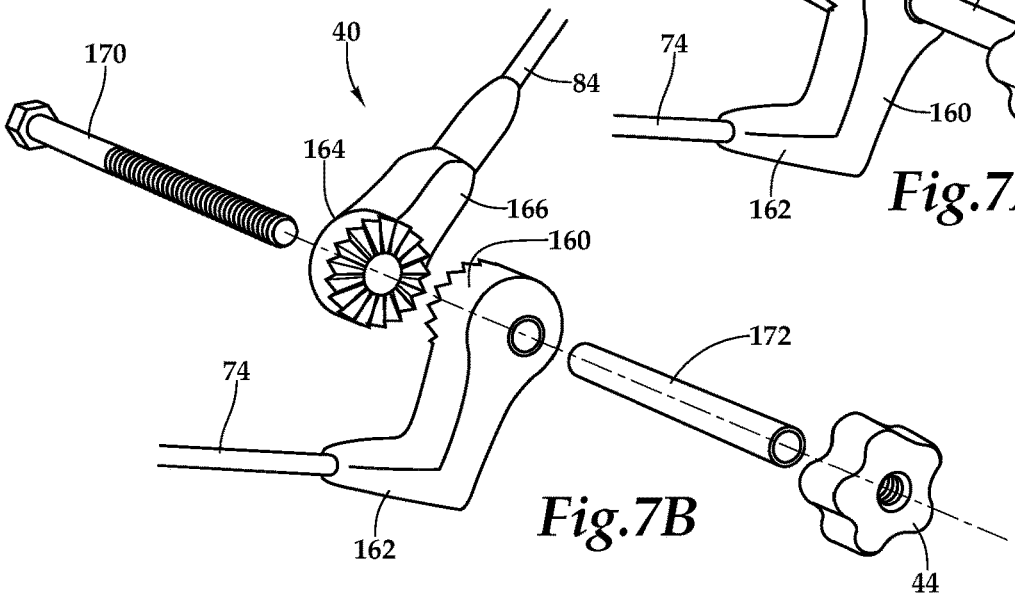
FIG. 7B is an exploded perspective view of the rear pivotal coupling and clutch assembly shown in FIG. 7A.

Referring now to FIG. 7A and FIG. 7B, with respect to the rear pivotal coupling and clutch assembly 40 as an example of the structure and function of the pair of rear pivotal coupling and clutch assemblies 40, 42, a fixed clutch member 160 is attached to the seat frame 74. A coupling body 166 extends from the fixed clutch member 160 to secure the fixed clutch member 160 to the seat frame 74. A movable clutch member 164 is attached to the back frame 84. A coupling body 162 extends from the movable clutch member 164 to secure the movable clutch member 164 to the back frame 84. The adjustment knob 44 is disposed externally of the frame members 70 with a threaded axle rod 170, which may be long enough to accommodate the left arm rest 22 that extends from the movable clutch member 164. The threaded axle rod 170 is housed within an exterior shaft 172. The movable clutch member 164 is movable from an engaged position in which the fixed clutch member 160 and the movable clutch member 164 are in contact with each other, to a disengaged position in which the fixed clutch member 160 and the movable clutch member 164 are separated from each other. The manually operable actuator is movable in a first direction for driving the movable clutch member into engagement with the fixed clutch member and movable in a second direction for releasing the movable clutch member 164 to permit separation of the clutch members and rotation of the back frame 84 relative to the seat frame 74. The fixed clutch member 160 and movable clutch member 164 may include complementary male and female end portions that are disposed in mating engagement with each other when the clutch members are in the engaged position.

Figure 8A:
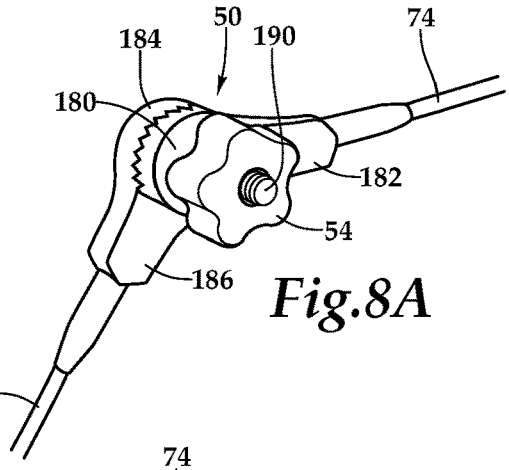
FIG. 8A is a front perspective view, partially broken away, of one embodiment of a forward pivotal coupling and clutch assembly shown in FIG. 5.
Figure 8B:
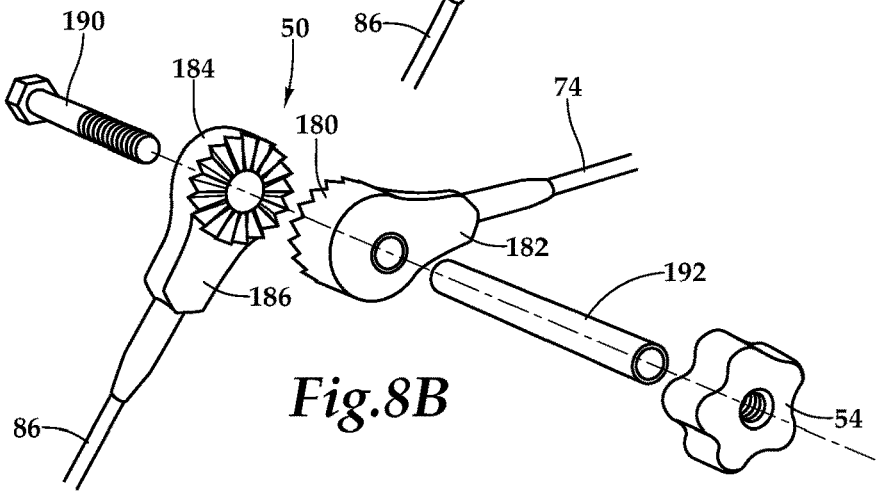
FIG. 8B is an exploded perspective view of the forward pivotal coupling and clutch assembly shown in FIG. 8A.

Referring now to FIG. 8A and FIG. 8B, with respect to the front pivotal coupling and clutch assembly 50 as an example of the structure and function of the pair of front pivotal coupling and clutch assemblies 50, 52, a fixed clutch member 180 is attached to the seat frame 74. A coupling body 182 extends from the fixed clutch member 180 to secure the fixed clutch member 180 to the seat frame 74. A movable clutch member 184 is attached to the leg frame 86. A coupling body 186 extends from the movable clutch member 184 to secure the movable clutch member 184 to the leg frame 86. The adjustment knob 54 is disposed externally of the frame members 70 with a threaded axle rod 190 that extends from the movable clutch member 184. The threaded axle rod 190 is housed within an exterior shaft 192. The movable clutch member 184 is movable from an engaged position in which the fixed clutch member 180 and the movable clutch member 184 are in contact with each other, to a disengaged position in which the fixed clutch member 180 and the movable clutch member 184 are separated from each other. The manually operable actuator is movable in a first direction for driving the movable clutch member into engagement with the fixed clutch member 180 and movable in a second direction for releasing the movable clutch member 184 to permit separation of the clutch members and rotation of the leg frame 86 relative to the seat frame 74. The fixed clutch member 180 and movable clutch member 184 may include complementary male and female end portions that are disposed in mating engagement with each other when the clutch members are in the engaged position.

As constructed, in one embodiment, the buoyant pool lounge chair frame 10 may be designed as a continuous form of pliable foam material of constant or appropriately varying density that varies in thickness to provide the buoyant cushions 14 having a protective coating 200 thereon. The construction may include molded foam being provided by a single molding process, and may include void spaces of select shapes to accommodate the cup holders or various components of the frame members, for example. In one embodiment, the construction includes slabs of closed cell polyurethane foam, such as closed cell polyurethane foam F, having a density in the range of approximately 1 lbs/ft3 (16 kg/m3) to approximately 6 lbs/ft3 (96 kg/m3). In one embodiment, any required frame members may be constructed of steel rod segments that are welded together or polyvinyl chloride (PVC) material. In another embodiment, multiple closed-cell PVC boards may be used sandwiched between foam slabs to increase the rigidity of components such as the chair seat, left arm rest, left arm rest, backrest, and leg rest. The protective coating 200, which is water proof, may be applied by various processes, including dipping and spraying, for example. Further, the frame members may be made by a partially or fully blown molded process depending on volumes. It should be appreciated that although a particular construction and materials are presented herein, the construction of the buoyant pool lounge chair 10 and buoyant pool lounge chair frame 12 presented herein may vary according to the particular application and other constructions and choices of materials within the teachings presented herein.

As previously alluded, special care should be taken in the consideration of buoyant lounge chairs to provide sufficient buoyancy material to maintain a stable upright orientation while the occupant is in a semi-reclining orientation following, in the present application, the engagement of the flotation device with the buoyant pool lounge chair frame 12 to provide the buoyant pool lounge chair 10. Such special care is warranted as any buoyant lounge chair can overturn in response to shifting of its center of buoyancy as the occupant turns or moves about. In one embodiment of the buoyant pool lounge chair 10 and the buoyant pool lounge chair frame 12, buoyancy sufficient to support an adult occupant having a body weight of 250 lbs (113 kg) is provided by the construction.

The order of execution or performance of the methods and operations illustrated and described herein is not essential, unless otherwise specified. That is, elements of the methods and flows may be performed in any order, unless otherwise specified, and that the methods may include more or less elements than those disclosed herein. For example, it is contemplated that executing or performing a particular step before, contemporaneously with, or after another step are all possible sequences of execution.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A buoyant pool lounge chair for supporting a person while the buoyant pool chair is floating in water, comprising:

frame members collectively forming an open chair frame, the frame members including a seat frame having a front end and a rear end, the seat frame having a top side and a bottom side;

the frame members including a leg frame pivotally coupled to the front end of the seat frame, the leg frame consists of first and second leg support members having respective first and second leg segments projecting therefrom and intersecting respective ends of a central leg segment;

buoyant cushions attached to the frame members, the buoyant cushions forming a chair seat, a backrest, and a leg rest; and a front pivotal coupling and clutch assembly coupling only the seat frame and the leg frame, the front pivotal coupling and clutch assembly including a manually operable actuator that is releasable to permit pivotal movement of the leg frame relative to the seat frame, and engageable to fix the angle of extension of the leg frame relative to the seat frame.

2. The buoyant pool lounge chair as recited in claim 1, wherein the front pivotal coupling and clutch assembly permits pivotal movement of the leg frame relative to the seat frame such that the leg frame is in proximate contact with the bottom side of the seat frame.

3. The buoyant pool lounge chair as recited in claim 1, wherein the front pivotal coupling and clutch assembly cooperates in pivotal movement to provide a storage configuration wherein the seat frame and the leg frame is in proximate contact with the bottom side of the seat frame.

4. The buoyant pool lounge chair as recited in claim 1, further comprising:

a left arm frame including an arm support riser that is laterally offset from the seat frame and an arm rest segment that is vertically offset from the seat frame; and a right arm frame including an arm support riser that is laterally offset from the seat frame and an arm rest segment that is vertically offset from the seat frame.

5. The buoyant pool lounge chair as recited in claim 4, further comprising buoyant cushions attached to the left arm frame and the right arm frame forming left and right arms rests.

6. The buoyant pool lounge chair as recited in claim 1, wherein the seat frame further comprises first and second parallel seat support members.

7. The buoyant pool lounge chair as recited in claim 1, wherein the manually operable actuator of the front pivotal coupling and clutch assembly further comprises an adjustment knob being disposed externally of the frame members.

8. The buoyant pool lounge chair as recited in claim 1, wherein the manually operable actuator of the front pivotal coupling and clutch assembly further comprises an adjustment knob being disposed externally of the frame members with a threaded axle rod based within an extension shaft.

9. The buoyant pool lounge chair as recited in claim 1, wherein the front pivotal coupling and clutch assembly further comprises:

a fixed clutch member attached to the seat frame;

a movable clutch member attached to the leg frame, the movable clutch member being movable from an engaged position in which the fixed clutch member and the movable clutch member are in contact with each other, to a disengaged position in which the fixed clutch member and the movable clutch member are separated from each other; and the manually operable actuator being movable in a first direction for driving the movable clutch member into engagement with the fixed clutch member and movable in a second direction for releasing the movable clutch member to permit separation of the clutch members and rotation of the leg frame relative to the seat frame.

10. The buoyant lounge chair as set forth in claim 9, wherein the fixed clutch member and movable clutch member include complementary male and female end portions, the male and female end portions being disposed in mating engagement with each other when the clutch members are in the engaged position.

11. The buoyant lounge chair as set forth in claim 9, wherein each of the pair of front pivotal coupling and clutch assemblies further comprises:

a first coupling body extending from the fixed clutch member, the first coupling body securing the fixed clutch member to the seat frame; and a second coupling body extending from the movable clutch member, the second coupling body securing the movable clutch member to the leg frame.

12. The buoyant pool lounge chair as recited in claim 1, wherein the manually operable actuator of the front pivotal coupling and clutch assembly further comprises an adjustment knob being disposed externally of the frame members.

13. A buoyant pool lounge chair for supporting a person while the buoyant pool chair is floating in water, comprising:

frame members collectively forming an open chair frame, the frame members including a seat frame having a front end and a rear end, the seat frame having a top side and a bottom side;

the frame members including a leg frame pivotally coupled to the front end of the seat frame, the leg frame consists of first and second leg support members having respective first and second leg segments projecting therefrom and intersecting respective ends of a central leg segment; and a front pivotal coupling and clutch assembly coupling only the seat frame and the leg frame, the front pivotal coupling and clutch assembly including a manually operable actuator that is releasable to permit pivotal movement of the leg frame relative to the seat frame, and engageable to fix the angle of extension of the leg frame relative to the seat frame.

14. The buoyant pool lounge chair as recited in claim 13, wherein the front pivotal coupling and clutch assembly permits pivotal movement of the leg frame relative to the seat frame such that the leg frame is in proximate contact with the bottom side of the seat frame.

15. The buoyant pool lounge chair as recited in claim 13, wherein the front pivotal coupling and clutch assembly, with pivotal movement, provides a storage configuration wherein the seat frame and the leg frame is in proximate contact with the bottom side of the seat frame.

16. The buoyant pool lounge chair as recited in claim 13, further comprising:

a left arm frame including an arm support riser that is laterally offset from the seat frame and an arm rest segment that is vertically offset from the seat frame; and a right arm frame including an arm support riser that is laterally offset from the seat frame and an arm rest segment that is vertically offset from the seat frame.

17. The buoyant pool lounge chair as recited in claim 13, wherein the seat frame further comprises first and second parallel seat support members.

18. A buoyant pool lounge chair for supporting a person while the buoyant pool chair is floating in water, comprising:

frame members collectively forming an open chair frame, the frame members including a seat frame having a front end and a rear end, the seat frame having a top side and a bottom side;

the frame members including a leg frame pivotally coupled to the front end of the seat frame, the leg frame consists of first and second leg support members having respective first and second leg segments projecting therefrom and intersecting respective ends of a central leg segment;

buoyant cushions attached to the frame members, the buoyant cushions forming a chair seat, a backrest, and a leg rest;

a front pivotal coupling and clutch assembly coupling only the seat frame and the leg frame, the front pivotal coupling and clutch assembly including a manually operable actuator that is releasable to permit pivotal movement of the leg frame relative to the seat frame, and engageable to fix the angle of extension of the leg frame relative to the seat frame; and the front pivotal coupling and clutch assembly permits pivotal movement of the leg frame relative to the seat frame such that the leg frame is in proximate contact with the bottom side of the seat frame in a storage configuration.

19. The buoyant pool lounge chair as recited in claim 18, further comprising:

a left arm frame including an arm support riser that is laterally offset from the seat frame and an arm rest segment that is vertically offset from the seat frame; and a right arm frame including an arm support riser that is laterally offset from the seat frame and an arm rest segment that is vertically offset from the seat frame.

20. The buoyant pool lounge chair as recited in claim 18, wherein the seat frame further comprises first and second parallel seat support members.

* * * * *